United States Patent [19]

Tang et al.

[11] 4,035,807

[45] July 12, 1977

[54] INTEGRATED MICROWAVE PHASE SHIFTER AND RADIATOR MODULE

[75] Inventors: Raymond Tang, Fullerton; Richard W. Burns, Orange, both of Calif.

[73] Assignee: Hughes Aircraft Company, Culver City, Calif.

[21] Appl. No.: 535,604

[22] Filed: Dec. 23, 1974

[51] Int. Cl.[2] ..... H01Q 3/26

[52] U.S. Cl. ..... 343/742; 343/700 MS; 343/768; 343/854

[58] Field of Search ..... 343/846, 854, 700 MS, 343/742, 768

[56] References Cited

U.S. PATENT DOCUMENTS

| | | | |
|---|---|---|---|
| 2,874,276 | 2/1959 | Dukes et al. | 343/846 |
| 3,386,092 | 5/1968 | Hyltin | 343/854 |
| 3,500,428 | 3/1970 | Allen | 343/854 |
| 3,665,480 | 5/1972 | Fassett | 343/754 |
| 3,771,158 | 11/1973 | Hatcher | 343/728 |
| 3,778,717 | 12/1973 | Okoshi et al. | 343/767 |
| 3,811,128 | 5/1974 | Munson | 343/846 |
| 3,832,716 | 8/1974 | Plunk et al. | 333/84 M |
| 3,887,925 | 6/1975 | Ranchelli et al. | 343/854 |

*Primary Examiner*—Eli Lieberman
*Attorney, Agent, or Firm*—William J. Bethurum; W. H. MacAllister

[57] ABSTRACT

A substantially two-dimensional integrated phase shifter and radiator module wherein a plurality of phase shifting elements are deposited in microstrip configuration on one side of a common substrate, and at least one radiating element is constructed from ground plane metallization on the other side of the substrate. Electrical coupling between the output of the phase shifter and the radiator is accomplished by means of a pin interconnect which extends vertically through the substrate. The phase shifting elements are serially connected and positioned in predetermined patterns on the substrate so as to maximize circuit density, without any adverse electrical interaction with the radiator. Additionally, the serially connected phase shifting elements are each connected to individually receive a separate DC control voltage in order that varying degrees of phase shift may be introduced into microwave signals which are coaxially fed into the input terminal of the phase shifting circuitry.

19 Claims, 18 Drawing Figures

Fig. 4a.
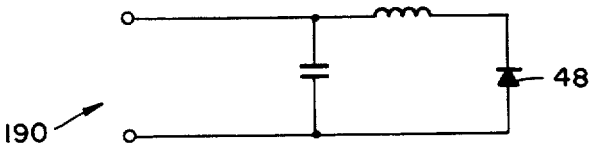
Fig. 4b.
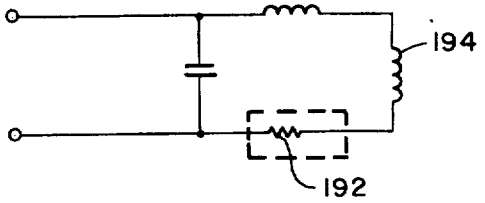
Fig. 5a.
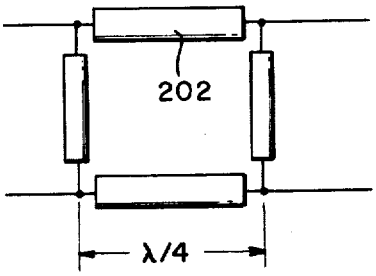
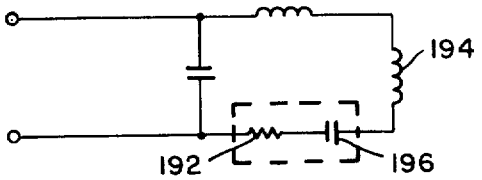
Fig. 4c.
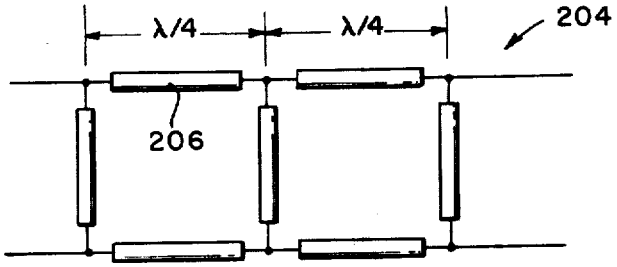
Fig. 5b.
Fig. 6.
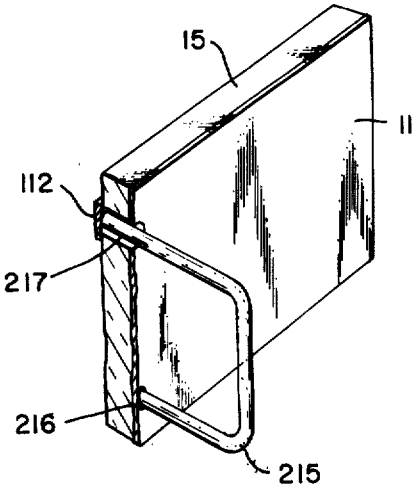
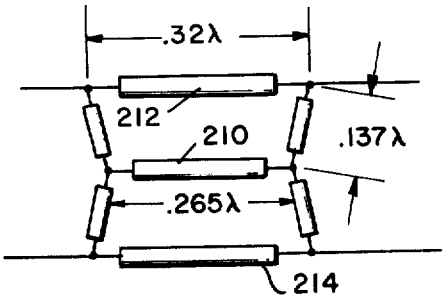
Fig. 5c.

Fig. 7.
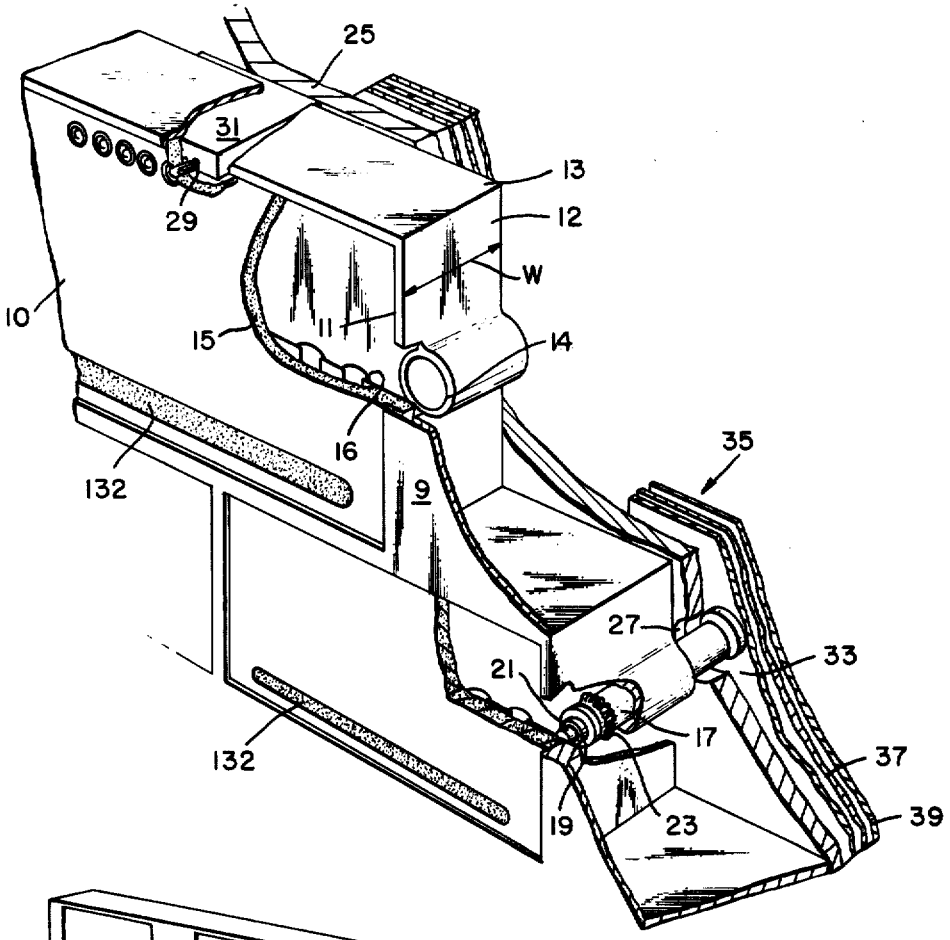
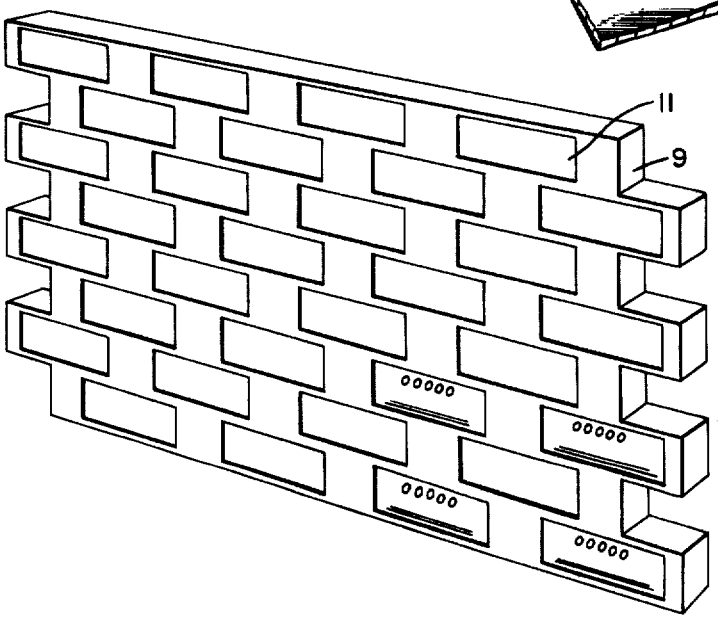
Fig. 8.

INTEGRATED MICROWAVE PHASE SHIFTER AND RADIATOR MODULE

FIELD OF THE INVENTION

This invention relates generally to phased array antennae and more particularly to a microelectronic integrated phase shifting and radiator circuit module for use in such antennae.

BACKGROUND

Phased array antenna systems for use in radar applications are generally well-known in the art and include, among other components, a means for distributing a microwave signal to be transmitted, some switching means to control the phase of the distributed signal, and some electrical means to couple the phase shifted signals to one or more remote signal radiating locations. Additionally, appropriate signal radiating means must be selected for these locations for projecting the phase shifted signals into space and in some predetermined phase relationship with like signals projected from adjacent radiators which make up the antenna. The phase of the signals received at a plurality of radiators which form a particular antenna must be shifted by predetermined amounts in order to establish a desired composite radiating wavefront which is projected into space from the complete antenna assembly.

There are several techniques for shifting the phase of incoming microwave signals prior to being transmitted from a microwave antenna, as described above, and among these include diode phase shifters which are connected to microstrip metallization patterns on one side of an insulating substrate. The substrate normally includes a ground plane on the other side thereof, and selected phase shift (bit) metallization patterns form the microstrip circuitry which extends between input and output terminals on one side of the substrate. Microwave switching diodes, such as PIN diodes, may be connected to selected terminals of the phase shift microstrip circuitry and there receive DC control signals which bias the PIN diodes to conduction and non-conduction, respectively, to thereby introduce varying degrees of phase shift into the microwave signals being processed.

PRIOR ART

In order to couple the phase shifted output signals from an output terminal or terminals of the substrate to appropriate microwave radiating means, it was necessary in the prior art to provide some suitable coupling means between the microstrip phase shifting circuitry and the chosen radiating element. Such coupling had to be both physically and electrically compatible with both the phase shifter and radiator components. For example, in order to electrically couple phase shift microstrip circuitry to a waveguide type of radiating element, one prior approach has been to use a coaxial connection between these two components. Using this approach, the inner coaxial conductor of the coax is connected to the phase shift microstrip circuitry on one side of the substrate and the outer coaxial conductor of the coax is connected to the ground plane on the other side of the substrate. Further, the outer wall of the radiating waveguide member is normally coupled to the above outer coaxial conductor, and the above inner coaxial conductor is connected through a central opening in the waveguide in such a manner as to set up an electromagnetic field which can then be propagated down the length of the waveguide. This type of coaxial interconnect is described, for example, in U.S. Pat. No. 3,686,624 to Napoli et al., and requires separate and distinct spaces for the phase shifting and signal radiating components of the module.

Another prior art technique for coupling phase shifted microwave signals from the output of a phase shifting network to a radiating element is described in U.S. Pat. No. 3,500,428 to C. C. Allen. In this patent, the microwave phase shifting circuitry is deposited as a microstrip on one side of an insulating substrate, and a waveguide type radiator is securely bonded to the other side of the insulating substrate. The rectangular waveguide in this patent is coupled to the above phase shifting circuitry by means of a vertical pin extending through the substrate. This configuration is also typical of the prior art phase shifting and radiating modules which require separate and distinct spaces (layers) of substantial thickness for accomodating these two discrete components which provide these two signal processing functions.

The module configuration in the above Allen patent is comprised of a three-dimensional multilayered structure, and the waveguide member therein is substantially larger in thickness than that of the circuit board (substrate) for the phase shifter. But in addition to the latter space requirements, the completed antenna assembly in FIG. 6 of Allen is configured such that the thickness of his outer case must be at least as great as one dimension of the substrate for the phase shifter. This approach imposes a serious design limitation on large antenna systems where space and weight savings are critical factors.

Thus, in all of the above and other prior art phase shifter and radiator modules known to us, the phase shifting element of the module is comprised of one physical unit of one discrete thickness and the radiating element is comprised of another separate physical unit of another discrete thickness. And as seen in the above Allen patent, this latter thickness is frequently more than twice the thickness dimension of the phase shifting module per se. Therefore, when using these prior art structures, not only must substantial space be allowed for mounting a large number of these units or modules in an antenna assembly, but the cost and weight of these individual units must also be accounted for where large numbers of these modules are used, for example, in large shipboard antennae. In some such antennae, literally thousands of these phase shifting and radiating elements are required for a single composite phased array antenna system.

THE INVENTION

The general purpose of this invention is to combine the above phase shifting and radiating elements into a single integrated two-dimensional module, thereby greatly decreasing the size, cost and weight requirements hitherto required by the above prior art systems. Simultaneously, performance and reliability of these combined components are greatly improved. To achieve this purpose, we have provided an integrated phase shifter and radiator module wherein a single substrate member supports microstrip phase shifting circuitry on one side thereof and supports a radiating element in a thin ground plane layer of metallization on the other side thereof. Electrical coupling between the phase shifting circuitry and the radiating element is achieved by means of a vertical pin interconnect which extends between opposite surfaces of the substrate.

Thus, when compared to the above prior art three-dimensional multi-layered modules, the present invention represents essentially a two-dimensional single layer configuration heretofore unknown to this art. In a preferred embodiment of the invention, the ground plane metallization on the side of the substrate opposite the phase shifting circuitry is utilized in the formation of a slot radiator. This feature enables a single metallization step to be utilized in the fabrication of both the ground plane and the slot radiator for the complete module, thereby substantially reducing the fabrication costs required in the construction of this module. Furthermore, as will be explained in further detail herein, the microstrip phase shifting circuitry is uniquely configured to maximize microstrip circuit density and phase shifting functions on one side of the substrate. This feature enables the substrate to fit within a fixed allowable area for each radiating element of a complete antenna array.

Accordingly, an object of the present invention is to provide a new and improved two-dimensional phase shifting and radiating module for a phased array antenna.

Another object is to provide a module of the type described whose size, cost and weight requirements have been greatly reduced relative to functionally corresponding prior art structures.

Another object is to provide a module of the type described which may be constructed almost entirely of conventional and advanced metal-on-dielectric metallization deposition processes, thereby insuring reliability in operation, durability of design, and a long life.

A feature of this invention is the provision of a module of the type described which, relative to the prior art, is essentially a single layer planar configuration. That is, essentially a single (substrate) thickness dimension is required in the fabrication of both the phase shifting circuitry and the radiating circuitry on opposite sides of a single substrate. This two-dimensional module is particularly adaptable to high density, low volume packaging in the construction of phased array antennae. This single layer construction can be made large enough to accommodate several phase shifting and radiating circuits.

Another feature is the provision of a module of the type described wherein four separate and distinct phase shift bits are serially connected in microstrip configuration on one side of an insulating substrate. These bits are coupled to a plurality of switching diodes which are in turn individually connected to receive separate DC control signals at a common feed location on the substrate.

A further feature is the provision of a module of the type described wherein the input terminal to the phase shifting circuitry is adapted to connect to a coaxial feed-in connection, and the output of the phase shifting circuitry is coupled through a microstrip connection and through a vertical pin interconnect directly to a slot radiator on the other side of the substrate.

Another feature of this invention is the provision of a substantially two dimensional planar module of the type described which is capable of conforming to and being bent into various shapes and configurations so as to conform, for example, to curved surfaces which are frequently characteristic of antennas and antenna systems.

Another feature is the provision of a complete phase array antennae which includes a plurality of these phase shifting and radiator modules which are integrally constructed in a novel manner to be described.

These and other objects and features of the invention will become more readily apparent in the following description of the accompanying drawings.

DRAWINGS

FIG. 1*a* is a plan view of the microstrip phase shifting circuitry on one side of the module according to the present invention.

FIG. 1*b* is a plan view of the other side of the module in FIG. 1*a*, showing the elongated slot radiator thereon.

FIG. 1*c* is a cross section view taken along lines *c—c* of FIG. 1*a*.

FIG. 4 illustrates three equivalent circuits for the 180° phase bit in FIG. 1*a* under varying conditions of control bias.

Figure 1C:
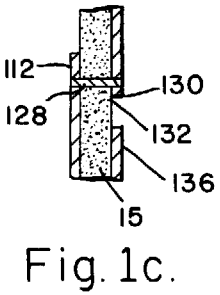
Figure 1B:
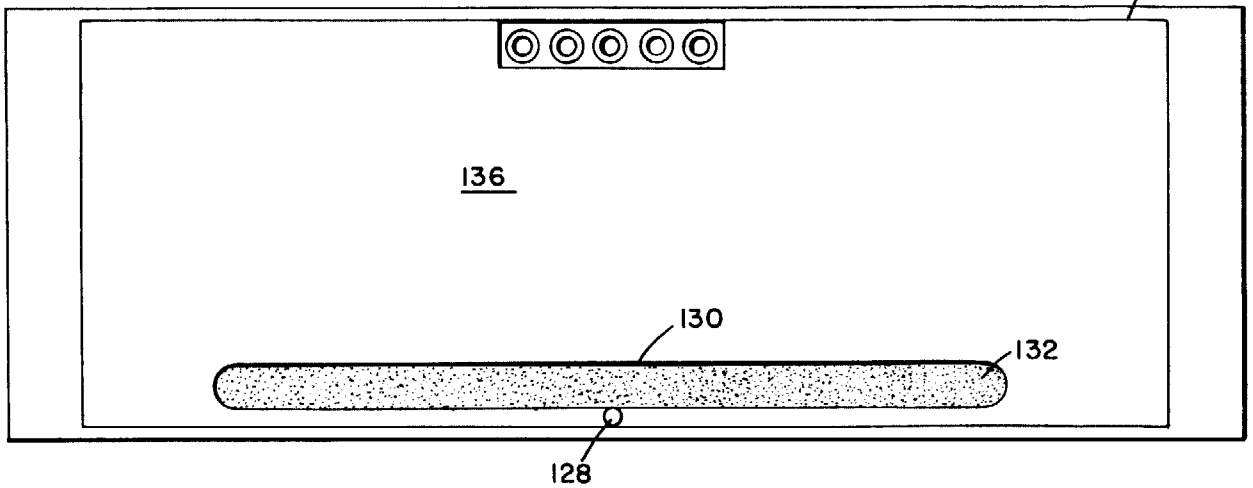
Figure 1A:
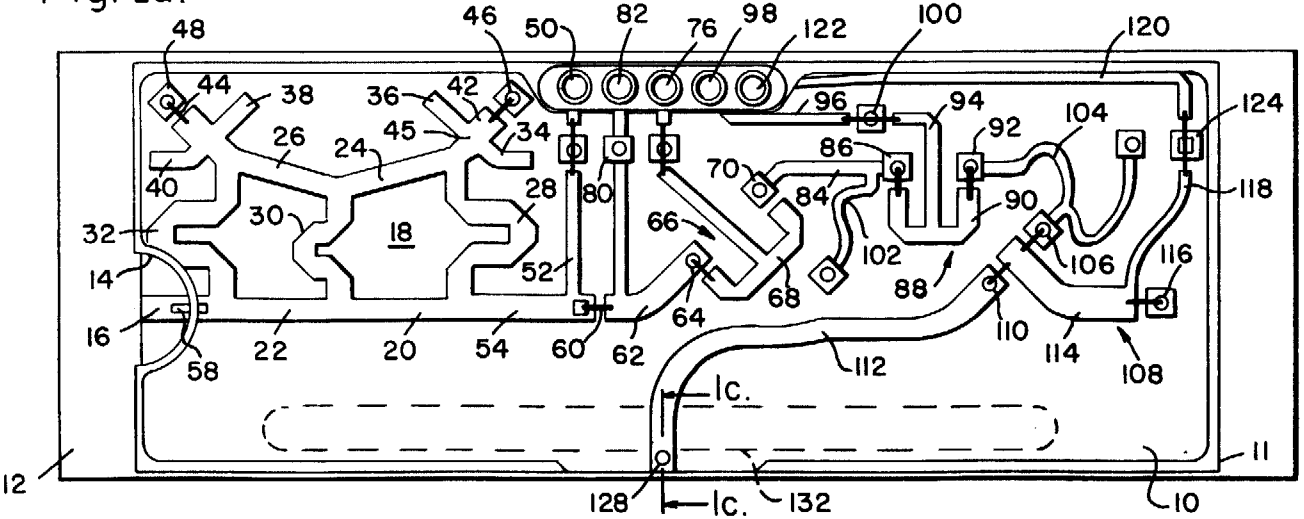

FIG. 5 serves to illustrate the branch coupler surface configuration (FIG. 5*c*) of the novel 180° phase bit in FIG. 1*a* relative to the prior art 3db couplers (FIGS. 5*b* and 5*c*).

FIG. 6 is a perspective view illustrating an alternative, metal loop radiator which may be utilized instead of the slot radiator shown in FIGS. 1*a* and 1*b* above.

FIG. 7 illustrates, in a partially sectioned perspective view, the coaxial input signal connection and the DC control pin connection into the module of FIGS. 1*a* and 1*b*, as well as the novel integrated construction of these modules.

FIG. 8 illustrates, in perspective view, a phased array antenna utilizing a plurality of modules of the type shown in FIG. 7.

Referring now to FIGS. 1*a* and 1*b*, there is shown a phase shifter and radiator module 10 which is mounted in an opening 11 in one wall of a metal package assembly 12. The package assembly 12 has a cylindrical passage 14 therein for receiving a coaxial signal input connection at the input port 16 of the microstrip circuitry to be described. Viewing now FIG. 1*a* from right to left, the first phase bit 18 is a novel 3db coupler with nonuniform spacing between the multiple branches therein. This directional coupler 18 varies from the typical two branch 3db coupler in that a third intermediate leg 30 is utilized, and the lengths of the three vertical legs of these branches are nonuniform in length as shown.

In addition to its input port 16, the 3db directional coupler 18 includes four horizontal sections 20, 22, 24 and 26 and the three previously mentioned vertical sections or branches 28, 30 and 32 as shown. The present design of coupler 18 further differs from that of conventional branch line couplers in that all of the horizontal sections thereof are shorter than $\lambda/4$. The sections 20, 22, 24 and 26 are all approximately 0.137 $\lambda$, where $\lambda$ is the wavelength of the microwave signal being processed, and the intermediate vertical section 30 of the coupler is approximately 0.265 $\lambda$. The outer vertical sections 28 and 32 of the coupler are approximately 0.32 $\lambda$, and these outer vertical sections 28 and 32, together with the horizontal sections 24 and 26 are joined, respectively, to pairs of double open stubs 34, 36 and 38, 40 on each end of the coupler 18. These double open stubs form part of the diode switches for the coupler 18 and include central regions 45 and 47 which are coupled via conductive bonding strips 42 and 44 to a pair of switching diodes 46 and 48. These diodes 46 and 48 are typically PIN diodes which are directly connected between the ends of the bonding strips 42 and 44 and the metallic ground plane on the opposite side of the module 10. The diodes 46 and 48 are also each connected to receive a DC control signal via terminal 50 and via the strip line 52 leading into the 3db coupler 18. An RF bypass capacitor 56 is connected between one side of the series microstrip line 52 and the ground plane for decoupling the DC bias terminal 50 from the RF line 54.

The 3db coupler 18 also includes conventional input and output RF coupling capacitors 58 and 60, and the output coupling capacitor 60 feeds into a microstrip section 62 which couples RF energy via a PIN diode 64 and into the T-shaped 45° phase bit 66 as shown. This phase bit 66 includes a cross member 68 which is connected in series with both an input PIN diode 64 and an output PIN diode 70, and phase bit 66 further includes a quarter wavelength (λ/4) stub 72 which feeds through a microstrip connection 74 to a 45° control bias terminal 76. The 45° bias terminal 76 is decoupled from the RF lines by means of the decoupling capacitor 78, and the input feed line 62 to the 45° phase bit 66 is grounded through a vertical pin interconnect 80 to a ground terminal 82. This pin interconnect attaches to the ground plane on the other side of the insulating substrate of the module 10.

The output PIN diode 70 of the 45° phase bit 66 is coupled via a microstrip section 84 to an input PIN diode 86 of the 22.5° phase bit 88. The phase bit 88 includes a horizontal cross-section 90 which is connected to both an input PIN diode 86 and to an output PIN diode 92, and this phase bit 88 further includes a λ/4 stub 94 which is coupled through a DC bias connection 96 to the 22.5° DC control terminal 98. The microstrip connection 96 is decoupled from the RF line by means of a decoupling capacitor 100. A microstrip ground connection 102 is connected as shown directly to the microstrip signal line 84 to thereby ground one side of both PIN diodes 70 and 86. These diodes 70 and 86 as well as the other series connected diodes in the circuit are biased between two substantially constant reactance values by the DC control voltages which are connected to the DC control terminals 50, 76, 98 and 122 previously described. This phase shifting is explained in more detail below with reference to FIG. 2.

The output PIN diode 92 of the 22.5° phase bit 88 is connected via a microstrip section 104 to an input PIN diode 106 of a 90° phase bit, which is designated generally 108. The 90° phase bit 108 includes an output PIN diode 110 which is connected to an output microstrip section 112, and the 90° phase bit 108 further includes a bent λ/4 stub 114 which is connected to yet another PIN diode 116. Diodes 106, 110 and 116 are connected to receive their DC control potentials via the two microstrip sections 118 and 120 which connect into the 90° DC control terminal 122 of the chassis. This latter DC control terminal 122 is decoupled from the RF line by means of an RF bypass capacitor 124. The specific function of the 90° phase bit 108, as well as the functions of the above identified 22.5°, 45° and 180° phase bits are described below with reference to the equivalent circuits in FIGS. 2 through 5.

The output microstrip section 112 of the module 10 is connected to a vertical interconnect pin 128 which extends through the substrate of the module 10 and connects to one edge of a slot radiator 130. This radiator 130 is formed as an elongated opening 132 in the ground plane metallization 136 on the reverse side of the insulating substrate. When phase shifted microwave output signals are received at the output terminal 128, this produces periodic fields across the slot 130. This varying field in turn propagates microwave radiation away from the slot in a predetermined phase relationship with radiation propagated from adjacent slots of the antenna array.

The slot radiator 130 is formed by etching or masking an elongated opening 132 in the ground plane of the substrate. The ground plane 136 must necessarily be formed on the side of the substrate opposite to the phase shifting circuitry in order to accommodate normal microwave propagation beneath the microstrip circuitry previously described. Thus a separate metallization step is not required in the formation of the slot radiator 130. Additionally, as a result of the particular spacing shown in FIG. 1*a* between the slot radiator 130 and the phase shifting circuitry, there is no adverse electrical interaction between these components. That is, since the slot radiator 130 is not immediately beneath the phase shifting circuitry shown in FIG. 1*a*, the signal propagation in the phase shifting circuitry does not adversely affect the normal operation and wave propagation from the slot radiator 130 on the opposite side of the substrate.

The radiation impedance of the slot 130 can be adjusted by varying either the length of the slot, the feeding position of the interconnect pin 128 or the width of the slot. Consequently, excellent impedance matching characteristics can be achieved by varying the above dimensions of the slot 130. In the construction of one particular slot radiator 130 which was fed as shown in FIG. 1*a*, the variable standing wave ratio (VSWR) of the slot radiator 130 was matched to better than 1.2 over about a 10% frequency band of the microwave signals propagated from the slot.

Referring now to FIG. 1*c*, there is shown, in elevation view, the specific utilization of a single dielectric substrate 15 as a means for carrying both the microstrip circuitry 112 on one side thereof and the ground plane metallization 136 on the other side thereof, and also for the construction of the radiating slot 132, which is formed by standard masking and etching techniques directly in the ground plane metallization 136. A vertical interconnect pin 128 is utilized for electrically coupling the phase shifted output signals on microstrip line 112 to the slot 132. Both the ground plane metallization 136 and the microstrip lead 112 are directly deposited on opposite surfaces of the dielectric substrate 15, using conventional aluminum or gold or other suitable state of the art metallization deposition techniques. The fact that the slot radiator 132 is formed directly in the ground plane metallization pattern 136 maximizes the functions of this ground plane metallization 136, while minimizing the space required for both the phase shifting and radiating componentry described.

Figure 2A:
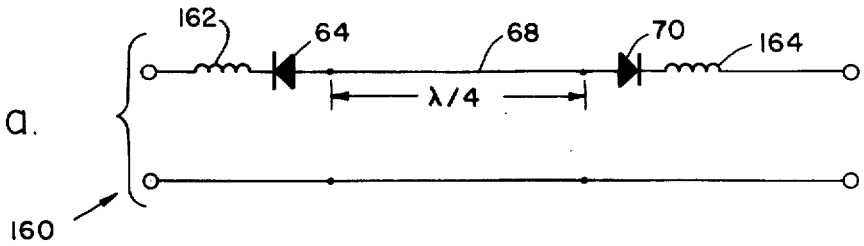
FIG. 2 illustrates three equivalent circuits for the 22.5° and the 45° phase bits in FIG. 1*a* under varying conditions of control bias.
Figure 2B:
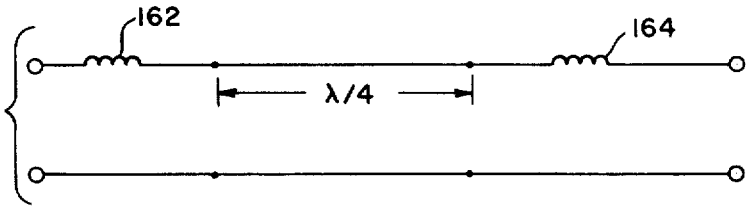
Figure 2C:
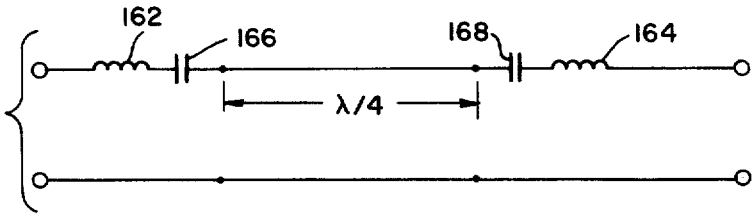

In FIG. 2*a* the equivalent circuit 160 is representative of either the 22.5° phase bit 88 or the 45° phase bit 66 previously described and shown in microstrip form in FIG. 1*a*. This equivalent circuit for phase bit 66 includes a λ/4 microstrip section 68 which separates the two PIN diodes 64 and 70. When these two diodes 64 and 70 are forward biased by a DC control voltage applied to terminal 76, they provide a very small resistance in series with the transmission line. Consequently, the predominant impedance of the phase bit 66 is the bonding strip inductance associated with each diode, whose reactance is adjusted to be $j.41$. The $j.41$ reactances for such inductances are shown at 162 and 164 in the equivalent circuit of FIG. 2*b*. When the PIN diodes 64 and 70 are reverse biased by a DC control voltage applied to terminal 76, the diodes now appear as capacitors 166 and 168, as seen in the equivalent circuit of FIG. 2*c*. The capacitor loading of each diode in FIG. 2*c* is chosen to be $-j.82$, which gives a net reactance on each side of the transmission line 68 of $-j.41$. This is illustrated in the equivalent circuit in FIG. 2*c*. A capacitance reactance of $j.82$ is provided by approximately 1.2 picofarads of capacitance at S band.

The 22.5° phase bit 88 is also a T-shaped series coupled loaded line bit, and in order to use identical PIN diodes in both the phase bits 88 and 66, the λ/4 transformer sections 84 and 104 are used at the input and output of the 22.5° phase bit 88. These λ/4 transformer sections make the effective impedance level at the phase bit 88 100 ohms instead of 50 ohms, and this design effectively cuts the 45° phase shift in half to 22.5°.

Figure 3A:
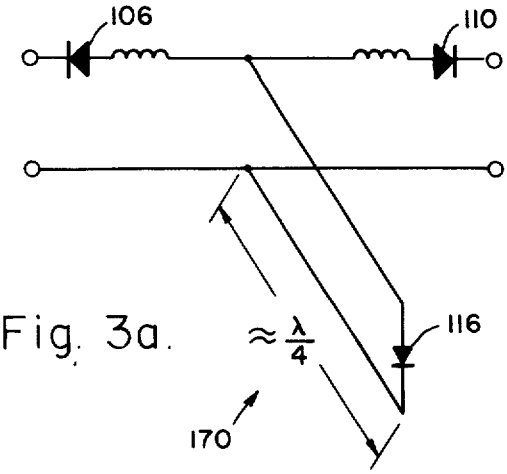
FIG. 3 illustrates three equivalent circuits for the 90° phase bit in FIG. 1*a* under varying conditions of control bias.
Figure 3B:
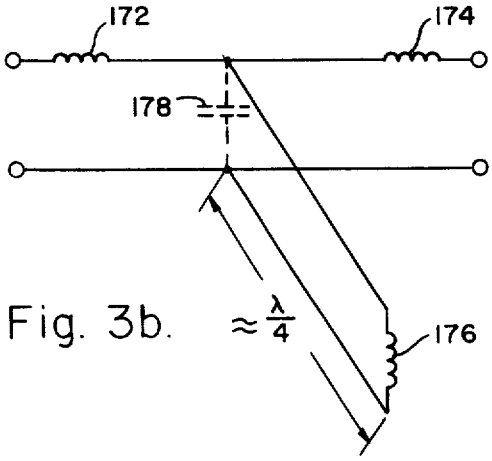

Referring now to FIG. 3, the three equivalent circuits shown therein represent the 90° phase bit 108 which uses the three diodes 106, 110 and 116, two of which are mounted in series with the microstrip lines 104 and 112. The third diode 116 is connected in shunt with the series lines 104 and 112 at the end of the quarter wavelength (λ/4) microstrip stub 114. When all of the PIN diodes 106, 110 and 116 in FIG. 3*a* are forward biased by the application of a DC control potential at terminal 122, the predominant impedance of the two series mounted diodes 106 and 110 is that of the two bonding wires or straps 109 and 111 whose series inductances 172 and 174 are shown in FIG. 3*b*. The shunt diode 116 is also seen as an inductance 176, which is transformed by the λ/4 stub 114 into a capacitance 178 appearing across the transmission line and between inductances 172 and 174. Thus, the transmission line in FIG. 3*b* becomes a low pass circuit under a forward bias condition.

Figure 3C:
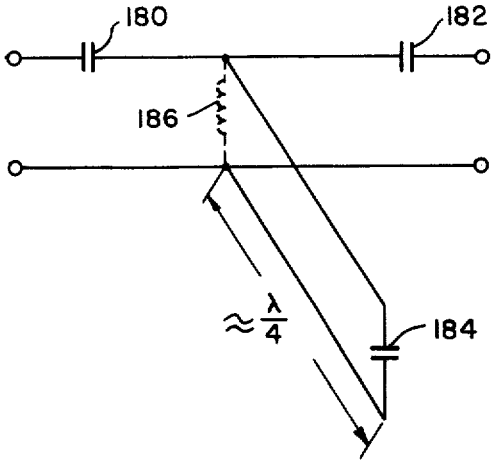

When the diodes 106, 110 and 116 in FIG. 3 are reverse biased by the application of a DC control voltage via microstrip connection 120 in FIG. 1*a*, these diodes all appear as capacitances 180, 182 and 184 as shown in FIG. 3*c*. These capacitances are larger in their reactance values than the inductances in FIG. 3*b*, so the predominant series impedance in FIG. 3*c* is capacitive. The capacitance 184 of the shunt PIN diode 116 is transformed by the λ/4 stud 114 into an inductance 186 which appears as shown across the transmission line in FIG. 3*c*. Thus, the equivalent circuit in FIG. 3*c* is a high pass circuit which provides a phase shift of 90° relative to the phase of signals passed by the low pass circuit of FIG. 3*b*.

Referring now to FIG. 4, there is shown in FIG. 4*a* an equivalent circuit 190 which is representative of each of the double open stub microstrip circuits 45 and 47 associated with and connected to the two PIN diodes 46 and 48 in the 180° phase bit 18 of FIG. 1*a*. When one of these PIN diodes 48 is forward biased, for example, the diode appears as a small resistance 192 connected in series with the inductance 194 of the bonding connection to the diode 48. For this condition of control bias, the equivalent circuit in FIG. 4*b* is in parallel resonance to thereby approximate an open circuit condition. When the PIN diode 48 is reverse biased by a DC control voltage applied to terminal 50, the diode 48 exhibits a capacitance 196 which appears in FIG. 4*c* in series with the diode's internal series resistance 192 and the bonding strip inductance 194. For this condition, the equivalent circuit in FIG. 4*c* appears as a short circuit across the stub 47 as a result of the series resonant condition between the diode capacitance and the bonding wire inductance.

Referring now to FIG. 5, two prior art 3db coupling networks shown in their equivalent circuit form in FIGS. 5*a* and 5*b* respectively will be initially described in order to provide a better understanding and appreciation of the novel 180° phase bit 3db coupler network shown in FIG. 5*c*. As will be described herein, the 3db coupler in FIG. 5*c* provides the signal coupling and 180° phase shifting functions within a minimum of space on the upper surface of the insulating substrate for the module 10. This feature is extremely important where the center-to-center spacing requirements between adjacent slot radiators in a phased array antenna dictate the maximum acceptable length of both the slot 130 and the surface area of the module 10.

The new 3db directional coupler portion of the 180° phase shifting element 18 is shown in schematic diagram in FIG. 5*c*, and this coupler is explained by first considering the simple conventional 90° branch guide directional coupler in FIG. 5*a*. Each of the four branches 202 of this coupler are λ/4 in length, where λ is the wavelength of microwave signals being processed. The power applied to port 1 of this coupler is divided into two equal amounts in the coupler and these two equal half-powers are seen at the output ports 2 and 3. The directional coupler in FIG. 5*a* is probably the simplest 4-port branch guide directional coupler available and occupies a relatively small area when deposited in microstrip form on an insulating substrate. This coupler is limited to bandwidths on the order of 5% of a given microwave frequency.

If it is desired to increase the bandwidth of a branch type directional coupler to approximately 10%, and availability of substrate surface area is no problem, then the three branch directional coupler 204 in FIG. 5*b* may be utilized to accomplish this purpose. Each of the branches 206 in this 3db coupler are λ/4 in length, and the power outputs at the output ports 2 and 3 of this coupler are one half the power input to the input port number 1 thereof. Obviously, the disadvantage of using the coupler shown in FIG. 5*b* is that it requires approximately twice the amount of real estate as that required by the coupler in FIG. 5*a*. This disadvantage led to the novel construction of the nonuniform branch 3db coupler shown in FIG. 5*c*.

The coupler in FIG. 5*c* occupies less cross-sectional area than that of the conventional couplers with equal branches of the type shown in FIG. 5*b*; and this coupler in FIG. 5*c* is also easy to realize physically since the impedance levels of all the branches in the coupler are very nearly equal. The ohmic loss in the 180° bit coupler in FIG. 5*c* is small because the electrical path length through this hybrid coupler is relatively short and no high impedance lossy transmission lines are required by any of its branches. Like the conventional branch guide directional couplers in FIGS. 5*a* and 5*b*, the nonuniform spaced branch guide directional coupler in FIG. 5*c* has the property that microstrip transformers can be incorporated in the design so that it can be connected between different terminating resistances at pairs of output ports.

The novel branch guide coupler in FIG. 5*c* was constructed by using a central cross branch 210 with the two outside branches 212 and 214. The actual lengths of all of the individual branches of the directional coupler in FIG. 5*c* are given directly in the drawing. The normalized line impedances required for a 3db coupler of this configuration are all very close to 1.0 and this feature reduces junction effects which are severe in the two branch couplers, particularly at high frequencies when using microstrip or strip line circuits.

Although the slot radiator configuration 130 shown in FIGS. 1*a* and 1*b* is the best solution to the problem of weight and packing density using the above described module 10, this slot radiator 130 may nevertheless be replaced with a loop type radiator, such as the radiator shown in FIG. 6. This loop radiator 215 may be soldered to the ground plane 11 at a selected location 216 thereon, and one end 217 of the loop extends through the insulating substrate and connects directly to the output microstrip 112 section on the other side of the substrate.

Referring now to FIG. 7, there is shown in a fragmented perspective view the compartmentalized housing of the present antenna which includes a front panel 9 with a plurality of rectangular openings 11 therein for receiving a plurality of corresponding phase shifter and radiator modules 10 previously described. This housing further includes side and top walls 12 and 13 which define the individual compartments, and the side walls 12 include a plurality of cylindrical passages 14 therein for receiving the coaxial conductor carrying the input microwave signal to the phase shift input circuitry. The coaxial conductor includes an outer conductor member 17, a central dielectric member 19 and an inner conductor member 21, the latter of which makes electrical contact to the input port 16 of the microstrip phase shifting circuitry. The coaxial conductor further includes an RF shorting coil spring 23 thereon for grounding the outer coaxial conductor.

A bias signal distribution board 25 having a plurality of openings 27 therein for the coaxial conductors 17 has been configured to fit against the back of the housing as shown. A plurality of DC bias pins 29 extend from the board 25 and into a plurality of elongated passages in a bias pin holder 31. The other ends of these pins 29 project into electrical contact with the previously described DC bias terminals 50, 82, 76, 98, 122 on the microstrip phase shifting circuitry. The coaxial conductor 17 which passes through the opening 27 in the distribution board 25 is securely mounted to one face of a ground plane 33 of an air stripline feed structure 35.

The air stripline feed structure 35 is additionally comprised of an inner stripline circuit board 37 which carries the incoming microwave signals to be processed, and further includes an outer ground plane 39, so that both ground planes 39 and 33 are electrically coupled to opposite sides of the stripline board 37. It should be appreciated that the stacking of the phase shift and radiator module 10, the bias signal distribution board 25 and the air stripline feed 35 is all accomplished in substantially parallel planes. Therefore the overall antenna structure is characterized by a relatively high packing density and is restricted in thickness reduction to the width W of the individual compartments of the housing 13. This compartment width W in general is about $\lambda/4$ in length in order to provide the optimum reflection of the energy which is propagated inwardly of the panel 10 to the signal distribution board 25 and then reflected from the board 25, back through the slot 132 and away from the array. But for certain applications W could be significantly reduced, and in fact when the loop radiator in FIG. 6 is used, the entire housing structure could consist of a plurality of very closely spaced parallel plate type modules for components 9, 10, 12, 13, 31 and 35. That is, no reflection by a ground plane is necessary when the loop radiator is used. Such structure can be made capable of at least partially conforming to various geometrical configurations, such as a partially spherical surface.

FIG. 8 illustrates the complete phased array antenna structure according to this invention. This structure includes all of the modules 10 securely mounted in a plurality of corresponding compartments in the antenna housing and defined by the openings 11 therein. The particular geometrical configuration of the front panel 9 of the antenna structure and associated stacked modules is not, however, limited to a flat surface configuration as shown in FIG. 8, and may instead have a curved surface such as the convex or a concave type surface frequently used in antenna structures. Furthermore, the complete antenna housing array shown in FIG. 8 may be constructed so that instead of using individual openings 11 in the front panel 9, the entire front panel may be constructed to receive only a single module consisting of a large number of phase shifters and corresponding radiators on a single substrate. This alternative construction can be used, for example, where the AC and RF isolation provided by the individual compartments in FIG. 8 is not required.

Such module could be constructed using a single dielectric substrate, together with the necessary microstrip phase shifting and ground plate componentry on opposite surfaces of this single dielectric substrate. Using this alternative construction, a module could be inserted into one opening (not shown) in the front panel 9 of the housing, provided of course that a plurality of coaxial conductors 17 are available for connection at selected locations on the phase shifting microstrip circuitry in a manner similar to that described above with reference to FIG. 7.

This alternative module construction would consist of a single dielectric substrate having a plurality of individual phase shifter microstrip circuits on one side thereof and a common ground plane of the other side. The ground plate would be constructed to have a plurality of individual slot or loop radiators positioned opposite to and electrically coupled to the phase shifters in a manner identical to the electrical coupling illustrated in FIG. 1*a*.

The perspective view in FIG. 8 is utilized herein to illustrate not only the antenna construction which includes a plurality of indivual compartments, but also for the purpose of representing the front panel of our above-described alternative embodiment which may utilize a single substrate module consisting of a large number of phase shifters and corresponding radiators on a single substrate. That is, if such a module were inserted in a large opening (not shown) in the front panel of the phased ray antenna described, then topographically it would look just like the front panel shown in FIG. 8. One would still see the individual phase shifter and radiator networks isolated, one from another, on a single substrate. But no compartment walls would be required, other than those utilized to bring in microwave signals and DC control voltages. In both of the above described constructions, the particular vertical and lateral spacings between adjacent slots 132 is dictated by the frequency band of the microwave signals being propagated; and the particular spacing utilized is within the ordinary skill of this art. For a further discussion of such vertical and lateral spacing requirements for adjacent slots 132 in a phased array antenna, reference may be made to a book by Silver entitled *Microwave Antenna Theory and Design*, Radiation Laboratory Series, Vol. 12.

It should also be understood that the present invention is in no way restricted to the particular 4-bit construction illustrated in FIG. 1*a*, and may instead use more or less than 4-bits, such as 3 or 5 bit phase shifters.

What is claimed is:

1. A composite integrated phase shifting and radiator structure for receiving, phase shifting and radiating microwave signals in a predetermined direction, including in combination:

a. a dielectric substrate having spaced-apart major surfaces and an opening therethrough extending between said surfaces, b. a plurality of microstrip phase shifters of predetermined configuration on one surface of said substrate for receiving microwave signals and altering the phase thereof, said phase shifters configured to provide different shifts in phase of an RF signal and disposed at predetermined spaced locations on said one surface of said substrate, said phase shifters further connected to an RF input port and connected via a plurality of microstrip bias lines, respectively, to a corresponding plurality of DC bias terminals, c. said microstrip phase shifters, said microstrip bias lines, said DC bias terminals and said RF input port being substantially coplanar, thereby facilitating the connection of RF and bias signals to a single plane of said phase shifting and radiator structure, d. a ground plane on the other surface of said substrate for providing the normal function of confining signals propagated in said dielectric substrate to the regions thereof beneath said microstrip phase shifters and connecting circuitry, e. said ground plane having a slot therein of predetermined configuration, and f. a conductor extending through said opening in said substrate and between an output port of said microstrip phase shifters and said slot for conducting current from said microstrip phase shifters to said ground plane to thereby set up a radiating electromagnetic field across said slot, whereby said ground plane provides the normal signal confining function for said substrate and additionally provides the output signal radiating function for said structure, thereby enabling said phase shifting and signal radiating functions of said structure to be accomplished using lightweight components which may be fabricated in a thin-layered substantially two-dimensional structure and with a high packaging density.

2. The invention defined in claim 1 wherein said microstrip circuitry includes b 22.5°, 45°, 90° and 180° bits of phase shift, each of which are connected to a plurality of switching diodes, respectively, for introducing varying degrees of phase shift into microwave signals received by said microstrip circuitry.

3. The invention defined in claim 1 wherein a plurality of PIN switching diodes are connected to a corresponding plurality of switching terminals on each of said phase bits for switching the impedance levels of said phase bits between discrete values to thereby shift the phase of microwave signals being processed by discrete amounts.

4. The invention defined in claim 3 wherein a plurality of said structures are mounted in a coplanar array to thereby form a phased array antenna assembly.

5. A phased array antenna including in combination a. a plurality of phase shifting and radiator composite structures mounted in a predetermined geometrical array, each of said structures including, b. a dielectric substrate having spaced apart major surfaces and an opening therethrough extending between said surfaces, c. a plurality of microstrip phase shifters of predetermined configuration on one surface of said substrate for receiving microwave signals and altering the phase thereof, said phase shifters configured to provide different shifts in phase of an RF signal and disposed at predetermined spaced locations on said one surface of said substrate, said phase shifters further connected to an RF input port and connected via a plurality of microstrip bias lines, respectively, to a corresponding plurality of DC bias terminals, d. said microstrip phase shifters, said microstrip bias lines, said DC bias terminals and said RF input port being substantially coplanar, thereby facilitating the connection of RF and bias signals to a single plane of said phase shifting and radiator structure, e. a ground plane on the other surface of said substrate for confining signals propagated in said dielectric substrate to the regions thereof beneath said microstrip phase shifters and connecting circuitry, and f. radiating means coupled to said ground plane and to said opening in said substrate for receiving therethrough phase shifted microwave signals and for radiating same away from said antenna.

6. The antenna defined in claim 5 wherein said radiating means is an elongated slot in the ground plane on one side of said substrate.

7. The antenna defined in claim 5 wherein said radiating means is a loop radiator connected at one end to said ground plane and at the other end to said opening in said substrate for receiving phase shifted signals from said microstrip circuitry and radiating same.

8. A phased array antenna including in combination a. a plurality of phase shifting and radiator composite structures mounted in a predetermined geometrical array, each of said structures including, b. a dielectric substrate having spaced apart major surfaces and an opening therethrough extending between said surfaces, c. microstrip circuitry of predetermined configuration on one surface of said substrate for receiving and distributing microwave signals and altering the phase thereof, d. a ground plane on the other surface of said substrate for confining signals propagated in said dielectric substrate to the regions thereof beneath said microstrip circuitry, e. radiating means coupled to said ground plane and to said opening in said substrate for receiving therethrough phase shifted microwave signals from said microstrp circuitry and for radiating same away from said antenna, f. said antenna further including a housing having a front panel with a plurality of openings therein for receiving a corresponding plurality of said composite phase shifting and radiating structures, g. said housing further having a plurality of individual compartments therein corresponding to said openings and defined by a plurality of adjoining walls extending normal to said front panel, h. said walls having a plurality of passages therethrough aligned with respective signal input ports of said phase shifting and radiating structures, and i. conductor means extending through said passages and into electrical contact with said input ports for coupling thereto microwave signals to be phase shifted and radiated from said antenna, said front panel and the rear of said compartments lying in closely spaced parallel planes and rendering said housing adaptable for stacking with one or more bias or other signal distribution boards in planes substantially parallel to the front panel of said housing, thereby achieving a high packing density.

9. The antenna defined in claim 8 which further includes a bias signal distribution board mounted adjacent the rear of said compartments and in a plane normal to said walls, and a plurality of DC bias pins extending from said distribution board to predetermind bias terminals on said microstrip circuitry.

10. The antenna defined in claim 9 which further includes a strip line circuit board coupled to said conductor means and mounted in a plane substantially parallel to the planes of both said bias signal distribution board and said front panel.

11. The antenna defined in claim 10 which further includes:

a. a pair of ground planes on each side of said strip line circuit board, with one of said ground planes being fixedly mounted to support said conductor means, and b. said conductor means comprising a coaxial conductor extending from said one ground plane and through said passage in a wall into contact with said microstrip circuitry.

12. A microwave antenna structure including, in combination:

a. a housing having a front panel of predetermined geometrical configuration with a plurality of spaced apart openings therein corresponding to a plurality of individual compartments of said housing, b. said compartments being further defined by a plurality of walls normal to said front panel and having a plurality of passages therethrough, c. a plurality of composite phase shifting and radiating circuit board modules each having phase shift microstrip circuitry on one side thereof and radiating means on the other side thereof electrically coupled through said modules, said modules mounted in a corresponding plurality of openings in said front panel of said housing, said microstrip circuitry including a plurality of microstrip phase shifters of predetermined configuration for receiving microwave signals and altering the phase thereof, said phase shifters configured to provide different shifts in phase of an RF signal and disposed at predetermined spaced locations on one surface of said circuit board modules, said phase shifters further connected to an RF input port and connected via a plurality of microstrip bias lines, respectively, to a corresponding plurality of DC bias terminals, said microstrip phase shifters, said microstrip bias lines, said DC bias terminals and said RF input port being substantially coplanar, thereby facilitating the connection of RF and bias signals to a single plane of said modules, and d. separate conductor means extending through a plurality of passages in said walls and electrically coupling microwave signals to input terminals of said microstrip phase shifting circuitry on one side of said modules.

13. The antenna structure defined in claim 12 wherein said radiating means in each module is a slot radiator within a predetermined area of a ground plane on one side of said substrate.

14. The antenna structure defined in claim 12 wherein said radiating means is a loop radiator connected at one end to a ground plane on one side of said substrate and further coupled at its other end through said substrate to receive phase shifted signals from microstrip circuitry on the other side of said substrate.

15. A microwave antenna structure including, in combination:

a. a housing having a front panel of predetermined geometrical configuration with a plurality of spaced spart openings therein corresponding to a plurality of individual compartments of said housing, b. said compartments being further defined by a plurality of walls normal to said front panel and having a plurality of passages therethrough, a plurality of composite phase shifting and radiating circuit board modules each having phase shift microstrip circuitry one one side thereof and radiating means on the other side thereof electrically coupled through said module, said modules mounted in a corresponding plurality of openings in said front panel of said housing, d. conductor means extending through a plurality of passages in said walls and electrically coupling a microwave signal to an input terminal of said microstrip phase shifting circuitry on one side of said module, and e. said antenna structure further including a bias signal distribution board adjacent the rear of said compartments and in a plane substantially parallel to said front panel, and a plurality of DC bias pins extending from said bias signal distribution board into electrical contact with a plurality of bias terminals on said microstrip circuitry.

16. The antenna structure defined in claim 15 which further includes a strip line circuit board coupled to said conductor means and mounted in a plane substantially parallel to the planes of said bias signal distribution board and said front panel whereby the stacking of said boards and said panel in substantially parallel planes is consistent with a high packing density for said structure.

17. The antenna defined in claim 16 which further includes a ground plane on each side of said strip line circuit board for confining microwave signal propagation to predetermined areas of said strip line circuit board, and said conductor means being a coaxial conductor extending from one ground plane and through a passage in a wall of said housing into electrical contact with an input terminal on said microstrip circuitry.

18. A composite phase shifting and radiating structure for receiving, distributing and shifting the phase of microwave signals and propagating same into space, including in combination:

a. a single dielectric or semi-insulating substrate of predetermined thickness and having spaced apart major surfaces adapted to receive thin metallization patterns thereon;

b. a plurality of microstrip phase shift circuits disposed on one side of said substrate and operative to receive and shift the phase of microwave signals, said circuits including a plurality of individual phase shifters configured to provide different shifts in phase of an RF signal and disposed at predetermined spaced locations on said one side of said substrate, said phase shifters further connected to an RF input port and connected via a plurality of microstrip bias lines, respectively, to a corresponding plurality of DC bias terminals, said microstrip phase shifters, said microstrip bias lines, said DC bias terminals and said RF input port being substantially coplanar, thereby facilitating the connection of RF and bias signals to a single plane of said phase shifting and radiator structure;

c. a single ground plane deposited on the other side of said substrate for providing the normal function of confining signals propagated in said substrate to the regions thereof beneath said individual microstrip phase shift and connecting circuits;

d. said ground plane having a plurality of slot radiators therein of predetermined geometrical configuration and aligned with corresponding output microstrip lines of individual ones of said microstrip phase shift circuits, and e. a plurality of conductors extending through a plurality of corresponding openings in said substrate between output ports of the individual microstrip phase shift circuits and said plurality of slot radiators, respectively, whereby said single ground plane provides the normal signal confining function for said substrate, and additionally provides a means for radiating a plurality of phase shifted signals from individual ones of said microstrip phase shift circuits.

19. A phase shifting and radiating element for receiving, phase shifting and radiating microwave signals in a predetermined direction, including in combination:

a. an insulating substrate having spaced apart major surfaces, b. a plurality of microstrip phase shifters of predetermined configuration disposed on one major surface of said substrate for receiving microwave signals and altering the phase thereof, said phase shifters configured to provide different shifts in phase of an RF signal and disposed at predetermined spaced locations on said one surface of said substrate, said phase shifters further connected to an RF input port and connected via a plurality of microstrip bias lines respectively to a corresponding plurality of DC bias terminals, said microstrip phase shifters, said microstrip bias lines, said DC bias terminals and said RF input port being substantially coplanar, thereby facilitating the connection of RF and DC bias signals to a single plane of said phase shifting and radiating element, c. a ground plane on the other major surface of said substrate for providing the normal function of confining signals propagated in said insulating substrate to the regions thereof beneath said microstrip phase shifters and their connecting circuitry, d. said ground plane having a slot radiator therein of predetermined configuation, and e. means for coupling output signals from an output port of said phase shifters and through said insulating substrate to said slot radiator on the opposite side of said substrate to thereby set up a radiating electromagnetic field across said slot radiator, whereby said element is a substantially two-dimensional phase shifting and radiating element, neglecting the thickness of said insulating substrate, thereby enabling said element to be combined with RF input and DC bias switching networks at a high-packing density.

* * * * *